US008733249B2

(12) United States Patent
Rancourt et al.

(10) Patent No.: US 8,733,249 B2
(45) Date of Patent: May 27, 2014

(54) REAL-TIME PRINT PRODUCT STATUS

(75) Inventors: Michael Raymond Rancourt, Merrimack, NH (US); Michael Lee Hearn, Dover, NH (US); Bradley Maurice Estabrook, Rochester, NH (US)

(73) Assignee: Goss International Americas, Inc., Durham, NH (US)

( * ) Notice: Subject to any disclaimer, the term of this patent is extended or adjusted under 35 U.S.C. 154(b) by 1072 days.

(21) Appl. No.: 11/708,248

(22) Filed: Feb. 20, 2007

(65) Prior Publication Data

US 2008/0196612 A1 Aug. 21, 2008

(51) Int. Cl.
*B41F 33/02* (2006.01)

(52) U.S. Cl.
USPC ..... 101/480; 101/484; 101/226

(58) Field of Classification Search
CPC ..... B41F 33/02; B41F 33/0036; B41F 19/008
USPC ..... 101/480, 484, 227, 226, DIG. 45; 270/52.04, 21.1, 20.1
See application file for complete search history.

(56) References Cited

U.S. PATENT DOCUMENTS

| | | | | |
|---|---|---|---|---|
| 4,321,592 | A | 3/1982 | Crandall et al. | |
| 4,340,893 | A * | 7/1982 | Ort | 347/102 |
| 4,346,446 | A * | 8/1982 | Erbstein et al. | 702/182 |
| 4,966,074 | A | 10/1990 | Aldrich, Jr. | |
| 5,412,577 | A * | 5/1995 | Sainio et al. | 700/124 |
| 5,521,844 | A * | 5/1996 | Karis | 702/185 |
| 5,778,791 | A | 7/1998 | Albus et al. | 101/483 |
| 5,949,550 | A | 9/1999 | Arndt et al. | |
| 5,999,636 | A | 12/1999 | Juang | 382/112 |
| 6,112,658 | A | 9/2000 | Gunther et al. | |
| 6,377,247 | B1 | 4/2002 | Halverson et al. | |
| 6,412,413 | B1 * | 7/2002 | Tice et al. | 101/409 |
| 6,507,832 | B1 * | 1/2003 | Evans et al. | 706/61 |
| 6,553,908 | B1 | 4/2003 | Richards et al. | |
| 6,867,423 | B2 | 3/2005 | Warner | |
| 2004/0128083 | A1 | 7/2004 | Wang et al. | 702/35 |
| 2004/0168886 | A1 | 9/2004 | Quadracci et al. | |
| 2006/0196936 | A1 | 9/2006 | Christofferson et al. | |

FOREIGN PATENT DOCUMENTS

| | | |
|---|---|---|
| DE | 10 2004 015333 A1 | 10/2005 |
| JP | 2002-292830 | 10/2002 |
| JP | 2003-048310 | 2/2003 |

* cited by examiner

*Primary Examiner* — Judy Nguyen
*Assistant Examiner* — Jennifer Simmons
(74) *Attorney, Agent, or Firm* — Davidson, Davidson & Kappel, LLC

(57) ABSTRACT

A web printing press is provided including a printing unit for printing a web, a delivery for printed products formed from the web, the web and printed products defining a printed product stream, a first sensor sensing a first characteristic of the web or printed products, a controller connected to the first sensor, and an indicator indicating in real-time a print defect in the printed product stream as a function of the first sensor. A method is also provided.

11 Claims, 3 Drawing Sheets

REAL-TIME PRINT PRODUCT STATUS

BACKGROUND

The present invention relates generally to printing presses and more particularly to automatically controlled printing presses.

In a printing press, for example, an offset web printing press, the web is typically run through a printing section, a dryer and a folder. Multiple characteristics of the web may change throughout the printing and finishing process. These characteristics include registration, such as lateral, circumferential and print-to-cut registration, and print quality, including color density, dot gain, and contrast. Other characteristics may include skew and wetness or dryness of the printed ink.

In automatically controlled printing presses, for example, Omnicon™ controls and Omni Makeready™ available for the Goss Sunday® and Goss M-600™, learning algorithms automatically adjust based on data from previous jobs and closed loop control allows full integration with the press controls to reduce response time and waste. The controller for the printing press is automatic and adjusts for a variety of characteristics without operator input.

BRIEF SUMMARY OF THE INVENTION

In the self-adjusting printing press systems, an operator may not be aware of changes in characteristics of the web including registration and print quality or at what location the changes are occurring, since the press is adjusting automatically. Thus, manual intervention by the operator may not be desired, and lead to undesired or improper interference with the automated processes.

In addition, automated systems may automatically reject products without knowledge of why the rejection is occurring.

The present invention provides a web printing press comprising:

a printing unit for printing a web;

a delivery for printed products formed from the web, the web and printed products defining a printed product stream;

a first sensor sensing a first characteristic of the web or printed products;

a controller connected to the first sensor; and an indicator indicating in real-time a print defect in the printed product stream as a function of the first sensor.

The present invention further provides a web printing press comprising:

at least one printing unit for printing a web;

a first sensor sensing a first characteristic of the web or a printed product at a first location downstream of the at least one printing unit;

a second sensor sensing a second characteristic of the web or the printed product at a second location downstream of the first location;

a controller connected to the first and second sensors; and a first indicator indicating a first web or printed product condition as a function of the first sensor at the first location and a second indicator indicating a second web or printed product condition as a function of the second sensor at the second location.

The present invention also provides a method for displaying print defects in a printing press printed product stream comprising the steps of:

sensing a characteristic of a web or printed product stream;

automatically controlling the printed product stream as a function of the sensing; and indicating in real-time a print defect in the printed product stream as a function of the sensing.

BRIEF DESCRIPTION OF THE DRAWINGS

A preferred embodiment of the present invention will be elucidated with reference to the drawings, in which.

DETAILED DESCRIPTION OF A PREFERRED EMBODIMENT

Figure 1:
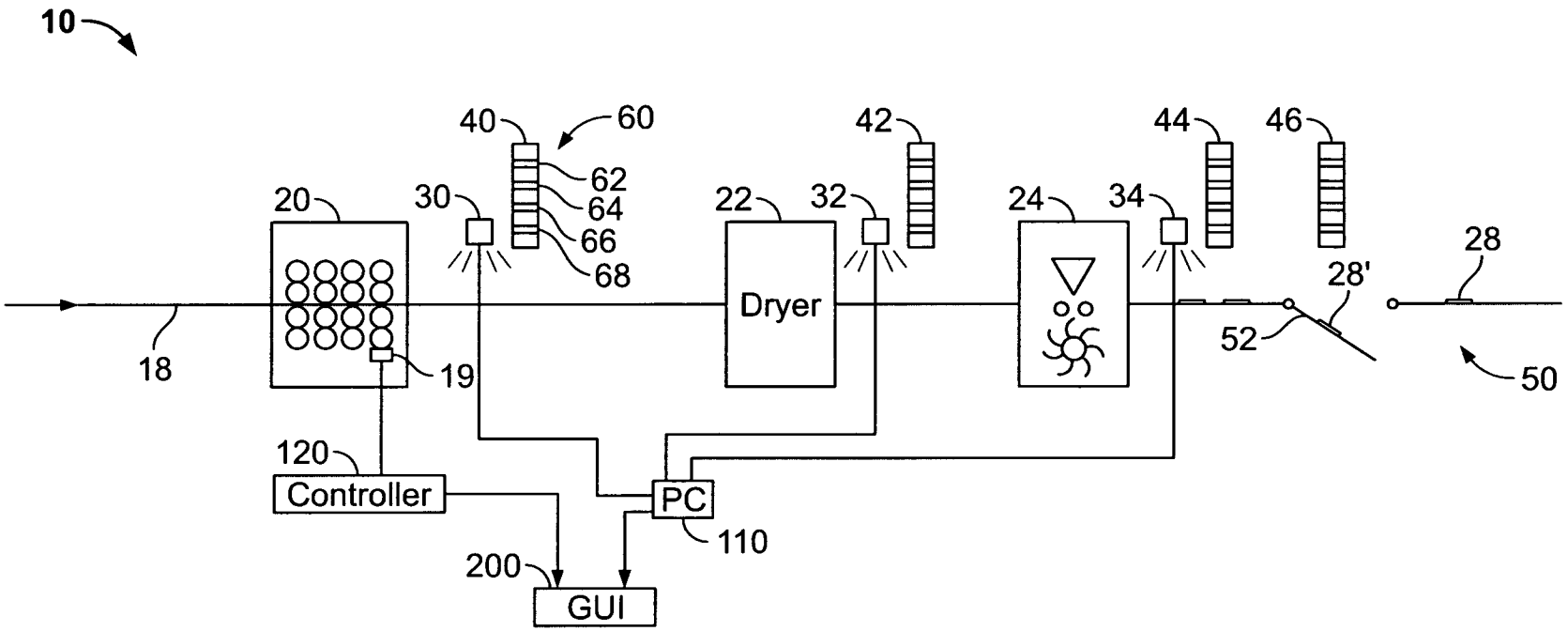
FIG. 1 shows a printing press having an indicator according to the present invention.

FIG. 1 shows a preferred embodiment of a printing press 10 including press components, such as, printing section 20, dryer 22 and folder 24. Printing section 20 prints an image on web 18, the image is dried via dryer 22 and folder 24 folds and cuts web 18 into printed products 28. Printed products 28 are transported to a conveyor 50. Conveyor 50 includes a waste gate 52 which discards rejected printed products 28'.

Printing section 20 is connected to a controller 120. Controller 120 counts the number of impressions printed on web 18, for example, through a counter 19 on a plate cylinder. Through known variables including distance and speed of press 10, controller 120 can determine the location of each impression along the path of web 18. Sensors 30, 32, 34 are connected to a personal computer (PC) 110. Controller 120 and PC 110 are connected to graphic user interface (GUI) 200.

Sensors 30, 32, 34 detect characteristics of web 18 including images printed on web 18 and resultant printed products 28. The detectable characteristics may include color density, dot gain, contrast, lateral register, circumferential register, skew, cut-off, print-to-cut registration and folder head-to-tail spacing, wetness, dryness and any other characteristic detectable on web 18 or printed products 28 during print production and finishing. The status of these characteristics may be detected at multiple locations in the product stream, for example, by sensors 30, 32, 34. Sensor 30 may be a color density sensor located downstream of printing section 20. Sensor 32 may be a dryer sensor located downstream of dryer 20 and sensor 34 may be a cut-off sensor located downstream of folder 24.

Each sensor 30, 32, 34 may be associated with a light indicator 40, 42, 44, for example, a light pole, having a lighting arrangement 60 that contains, for example, four lights 62, 64, 66, 68. Once sensors 30, 32, 34 detect a characteristic of web 18, the image or printed product 28, lighting arrangement 60 will illuminate lights 62, 64, 66, 68 in such a way to signal to an operator the real-time status of web 18, image or printed product 28. Preferably, light indicators 40, 42, 44 are controlled by and connected to PC 110, for example, via an Ethernet connection, each light indicator 40, 42, 44 having a controller 120 for receiving instructions from PC 110 and controlling the respective lights, 62, 64, 66, 68. For example, when sensor 34 detects printed product 28' has been improperly cut, lighting arrangement 60 on light indicator 44 signals product 28' is faulty due to improper cutting, for example, by illuminating a red light 62 on indicator 44 when product 28' passes sensor 34. If the next product after 28' is good as it passes sensor 34 the light is turned off. In addition, light indicator 46 signals the real-time status of waste gate 52. Light indicator 46 indicates when a good product 28 passes and the reasons why a bad product 28' is dumped via waste gate 52, and thus, for example, may illuminate red light 62 on indicator 46 when product 28' is at waste gate 52.

Figures 4, 5, 6, 7, 8, 9, 10:
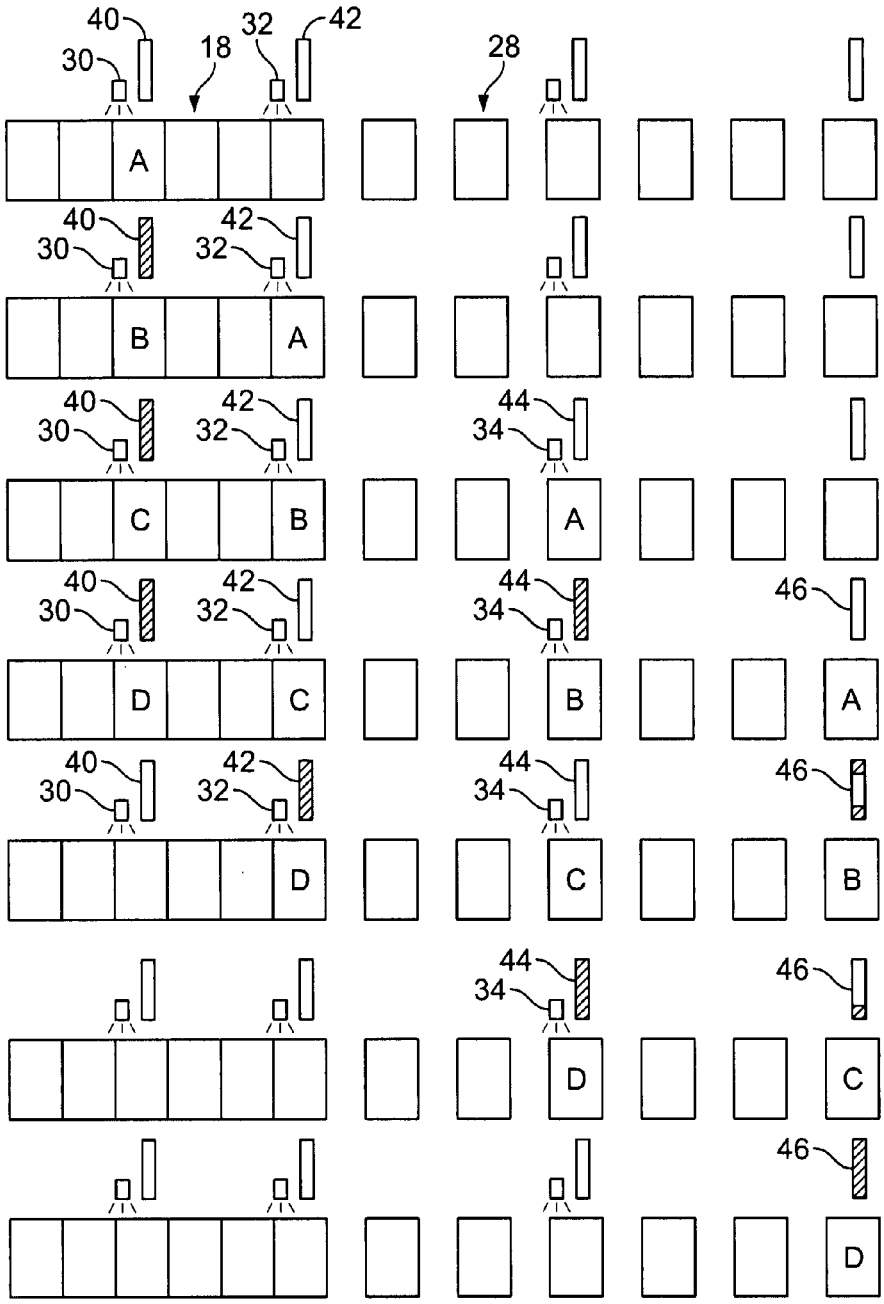
FIGS. 4 through 10 show a web and resultant printed products moving through the printing press in FIG. 1 at different points in time.

FIGS. 4 through 10 show four images A, B, C and D on web 18 and resulting printed products A, B, C and D moving through printing press 10 at different points of time $T_0$, $T_1$, $T_2$, $T_3$, $T_4$, $T_5$ and $T_6$. In FIG. 4, color density sensor 30 detects image A at an initial time $T_0$. Light indicator 40 indicates that the color density of image A is acceptable.

FIG. 5 shows a position of images A and B in printing press 10 a short time later, time $T_1$. Dryer sensor 32 detects image A. Light indicator 42 indicates the dryness of image A is acceptable. Color density sensor 30 detects image B. Light indicator 40 is illuminated in such a way to indicate the color density of image B is not acceptable so resultant product B will be rejected via waste gate 52 further downstream. At time $T_1$, the operator is alerted to the reject status of subsequent product B due to, at a minimum, unacceptable color density at indicator 40.

FIG. 6 shows a position of product A and images B and C in printing press at a later time, time $T_2$. Cut-off sensor 34 detects image A. Light indicator 44 indicates cut-off of product A is acceptable. Dryer sensor 32 detects image B. Light indicator 42 indicates dryness of image B is acceptable. Color density sensor 30 detects image C. Light indicator 40 indicates the color density of image C is not acceptable so resultant product C will also be rejected via waste gate 52 further downstream. Thus, at time $T_2$, the operator is alerted to the reject status of subsequent product C due to, at a minimum, unacceptable color density. It is also possible at indicator 42 to show that image B is not acceptable for color density. However, if this is not the case, only one light would be necessary at indicator 42 to indicate dryness.

FIG. 7 shows product A at waste gate 52 at a time $T_3$. Light indicator 46 indicates to the operator that product A is acceptable and will be further transported via conveyor 50. Cut-off sensor 34 detects product B. Light indicator 44 indicates cut-off of product B is not acceptable. Thus, at time $T_3$, the operator is alerted to another reason product B will be rejected via waste gate 52. Dryer sensor 32 detects image C. Light indicator 42 indicates dryness of image C is acceptable. Color density sensor 32 detects product D. Light indicator 40 indicates the color density of image D is not acceptable, so resultant product D will be rejected via waste gate 52 further downstream. Thus, at time $T_3$, the operator is alerted to the reject status of subsequent product D due to, at a minimum, unacceptable color density.

FIG. 8 shows product B at waste gate 52 at a time $T_4$. Light indicator 46 indicates product B is being rejected via waste gate 52 due to unacceptable color density and unacceptable cut-off. Light indicator 44 indicates product C has acceptable cut-off while light indicator 42 indicates dryness of image D is not acceptable. Thus, at time $T_4$, the operator is alerted to the real-time status of rejected product B due to unacceptable color density and unacceptable cut-off, the real-time status of product C at cut-off sensor 34 and the real-time status of image D at dryer sensor 32.

FIG. 9 shows product C at waste gate 52 at a time $T_5$. Light indicator 46 indicates product C is being rejected via waste gate 52 due to unacceptable color density. Cut-off sensor 34 detects product D and light indicator 44 indicates to the operator that cut-off for product D is unacceptable. Thus, at time $T_5$ light indicator 46 provides real-time status of rejected product C at waste gate 52 and product D at sensor 34.

FIG. 10 shows product D at waste gate 52 at a time $T_6$. Light indicator 46 indicates product D is being rejected due to unacceptable color density, unacceptable dryness and unacceptable cut-off. Thus, at time $T_6$, the operator is alerted to every reason why product D is being rejected via waste gate 52.

GUI 200 displays real-time status of web 18 and products 28, 28' for an operator. GUI 200 receives count data from controller 120 and process data from sensors 30, 32, 34. Taken in combination, GUI 200 creates a graphical representation of web 18 and products 28, 28' with real-time status providing a press operator or user with real-time status of web 18 and subsequent products 28, 28' running through printing press 10.

When the press operator knows real-time print status the operator may quickly determine print defects in the delivery stream, where print defects are located in the stream, and when delivery of bad products is expected. The press operator can use the status to evaluate the state, condition and trends of the printing cycle. Thus, the press operator can determine if printing press 10 is self-adjusting or if manual intervention is desired. Furthermore, instructions could be provided via GUI 200 to tell the operator what actions the software is taking to correct a problem, so that the operator does not take duplicative or interfering steps. Additionally, GUI 200 could inform the operator of information or instruction to correct the problem.

Figure 3:
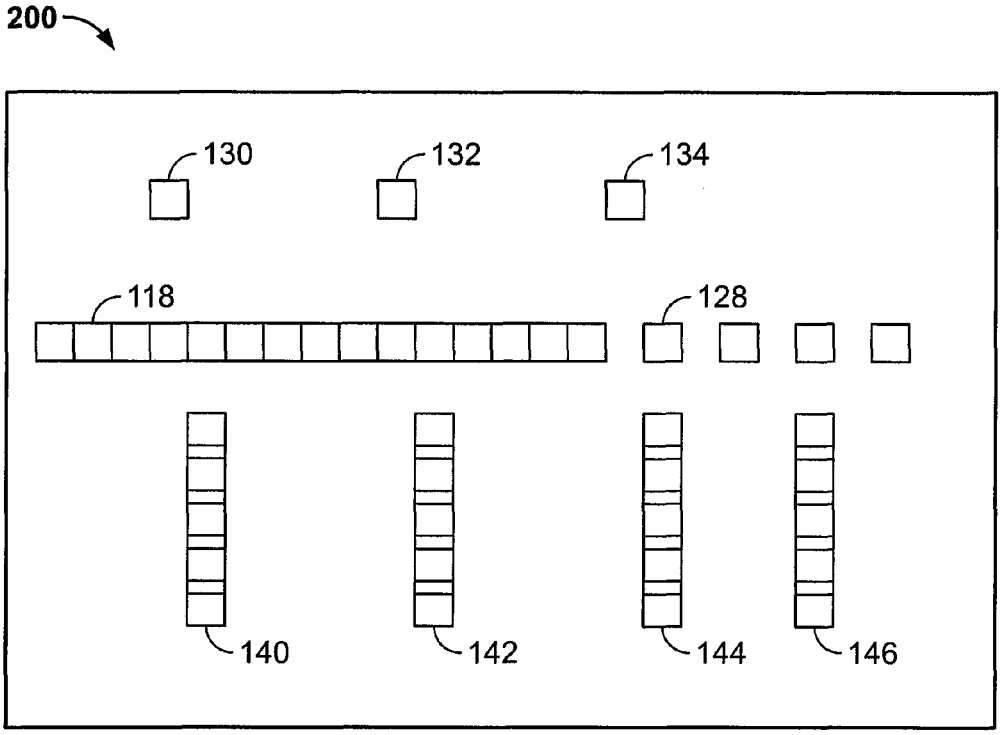
FIG. 3 shows a graphic user interface displaying the indicator in FIG. 1.

As shown in FIG. 3, the GUI 200 displays a graphical representation of real-time job status. Web icon 118 shows real-time status of web 18 (FIG. 1), sensor icons 130, 132, 134 show real-time status of sensors 30, 32, 34 (FIG. 1), light icons 140, 142, 144, 146 show real-time status of light indicators 40, 42, 44, 46 (FIG. 1) and product icons 128 show real-time status of printed products 28, 28' (FIG. 1). GUI 200 receives information from controller 120 and PC 110 to continually reflect changes in the real-time job status printing press 10.

Figure 2:
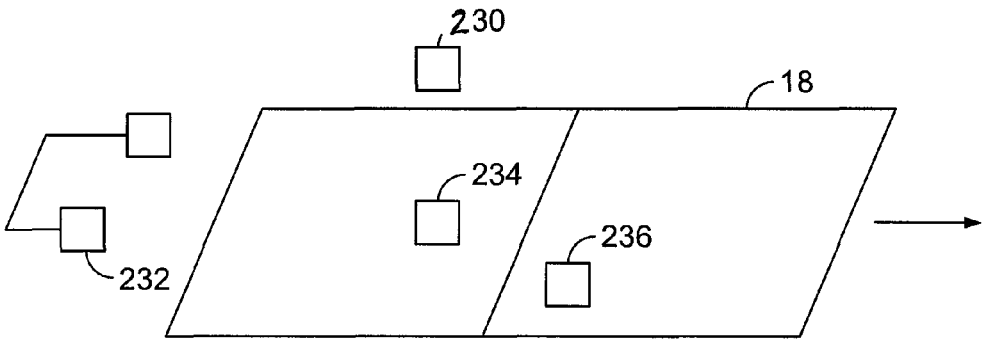
FIG. 2 shows sensors located along a web according to the present invention.

As shown in FIG. 2, a variety of sensors may be incorporated into the present invention. A skew sensor 232 may be aligned with web 18 to check skew along the path of web 18. Lateral register sensor 230 may be aligned alongside web 18 to check for disposition of web 18. Circumferential register sensor 234 may be positioned on the centerline of web 18 to check for disposition of web 18. Color density sensor 236 may be positioned to check color density of the impressions.

In an additional preferred embodiment the light device may be replaced with any type of indicating device. The indicator may be visual to alert the operator to real-time status. The indicators may be in a spatial relationship with the web and product stream. In an additional preferred embodiment, the graphical user interface may provide the indicators, whether or not light indicator poles are provided.

In a further preferred embodiment, tolerance ranges of each characteristic may be represented by light arrangements 60 on each light indicator 40, 42, 44, 46. In this embodiment, the operator can view trends developing at each sensor location. For example, a green light may indicate the product is within a first acceptable range, a yellow light may indicate the product is within a second acceptable range, an orange light may indicate the product is within a third acceptable range and a red light may indicate the product is not acceptable. The operator may also view the printing press 10 self-correcting characteristics at each sensor location.

In the preceding specification, the invention has been described with reference to specific exemplary embodiments and examples thereof. It will, however, be evident that various modifications and changes may be made thereto without departing from the broader spirit and scope of invention as set forth in the claims that follow. The specification and drawings are accordingly to be regarded in an illustrative manner rather than a restrictive sense.

What is claimed is:

1. A web printing press comprising:

a printing unit for printing a web;

a dryer located downstream of the printing unit, the dryer configured and arranged to dry the web;

a folder located downstream of the dryer, the folder configured and arranged to cut the web and to fold the cut web into printed products, the web and printed products defining a printed product stream;

a waste gate located downstream of the folder, the waste gate configured and arranged to discard unacceptable printed products;

a color density sensor located downstream of the printing unit and upstream of the dryer, the color density sensor configured and arranged to sense a color density of the web;

a first light indicator indicating in real-time a print defect in the web as a function of the color density sensor, the light indicator being located downstream of the printing unit, upstream of the dryer, and adjacent the web;

a cutoff sensor located downstream of the folder and upstream of the waste gate, the cut off sensor configured and arranged to sense a cutoff of the printed products;

a second light indicator indicating in real-time a print defect in one the printing products passing the cutoff sensor as a function of the cutoff sensor, the second light indicator being located downstream of the folder, upstream of the waste gate, and adjacent the printed products of the product stream;

a controller connected to the color density sensor and the cutoff sensor;

a graphic user interface separate from the first and second light indicators, the graphic user interface connected to the controller, the graphic user interface configured to graphically display a location in the printed product stream of each print defect indicated by the first and second light indicators.

2. The web printing press as recited in claim 1 further comprising:

a dryer sensor located downstream of the dryer and upstream of the folder, the dryer sensor configured and arranged to sense a dryness of the web;

a third light indicator indicating in real-time a print defect in the web as a function of the dryer sensor, the third light indicator being located downstream of the dryer, upstream of the folder, and adjacent the web;

wherein the graphic user interface is separate from the first, second, and third light indicators, the graphic user interface configured to graphically display a location in the printed product stream of each print defect indicated by the first second and third light indicators.

3. The web printing press as recited in claim 1 wherein the controller automatically controls the printing press as a function of the color density sensor and the cut off sensor.

4. The web printing press as recited in claim 1, wherein the location of a print defect indicated by the first light indicator is graphically displayed with an image of the first light indicator.

5. The web printing press as recited in claim 4 wherein the location of a print defect indicated by the second light indicator is graphically displayed with an image of the second light indicator.

6. The web printing press as recited in claim 1 wherein the location of a print defect indicated by the first light indicator is graphically displayed with an image of the color density sensor.

7. The web printing press as recited in claim 1 wherein the first light indicators is a light pole having a first light, the first light being controlled as a function of the color density sensor.

8. The web printing press as recited in claim 7 wherein the light pole includes a second light.

9. The web printing press as recited in claim 1 wherein at least one of the first and second light indicators is adapted to provide a visual representation of a tolerance or range of the print defect.

10. The web printing press as recited in claim 1 wherein at least one of the first light indicator and the second light indicator is adapted to output a different color light representing an associated tolerance or range of the print defect.

11. The web printing press as recited in claim 1 wherein the first light indicator is a first light pole, and wherein the second light indicator is a second light pole.

* * * * *